US005507111A

United States Patent [19]

Stinson et al.

[11] Patent Number: 5,507,111

[45] Date of Patent: Apr. 16, 1996

[54] GUN SUPPORT

[76] Inventors: Steven E. Stinson, 7396 Peaceful Valley Rd., Williamsburg, Mich. 49690; Robert E. Stinson, 7292 Peaceful Valley Rd., Acme, Mich. 49610

[21] Appl. No.: 299,910

[22] Filed: Sep. 1, 1994

[51] Int. Cl.[6] ..... F41C 27/00

[52] U.S. Cl. ..... 42/94

[58] Field of Search ..... 42/94; 89/37.04; 248/163.1, 164, 460; 108/115

[56] References Cited

U.S. PATENT DOCUMENTS

| | | | |
|---|---|---|---|
| 1,524,973 | 2/1925 | Hazelton | 42/94 |
| 3,235,998 | 1/1965 | Hadley | 42/94 |
| 3,445,082 | 12/1966 | Proctor et al. | 248/186 |
| 3,954,068 | 5/1976 | Roberts et al. | 108/115 |
| 4,017,997 | 4/1977 | Peterson et al. | 42/94 |
| 4,112,855 | 9/1978 | Colby | 108/159 |
| 4,397,112 | 8/1983 | York | 42/94 |
| 5,311,693 | 5/1994 | Underwood | 42/94 |
| 5,317,826 | 6/1994 | Underwood | 42/94 |
| 5,377,437 | 1/1995 | Underwood | 42/94 |
| 5,410,835 | 5/1995 | Vetter | 42/94 |

*Primary Examiner*—Charles T. Jordan
*Assistant Examiner*—Christopher K. Montgomery
*Attorney, Agent, or Firm*—Price, Heneveld, Cooper, DeWitt & Litton

[57] ABSTRACT

A novel gun rest or gun stand comprising a foldable bipod having a pair of rigid legs movably maintained in close proximity to one another by a flexible member, and detachably secured to one another by a clasping retainer member.

35 Claims, 4 Drawing Sheets

GUN SUPPORT

BACKGROUND OF THE INVENTION

The present invention relates generally to gun rests and stands for use in target shooting with firearms, especially long-barrelled guns such as rifles. The present invention particularly relates to an inexpensive and readily portable gun rest or stand which is useful in the field, for hunting, as well as other purposes, and is preferably in the form of a bipod.

Gun rests are used in a variety of recreational shooting applications. However, such rests are usually cumbersome, noisy, heavy, and typically difficult or relatively time-consuming to set up and/or attach to the gun. The present invention offers a novel lightweight and readily portable, combination gun rest and gun stand, utilizing nonmetallic components for both light weight and quietness in carrying, easy setup and good economy of manufacturing. The unique design of the present invention facilitates easy and convenient portability and use, quicker setup time and better accommodation of the gun barrel, while utilizing a minimum of relatively inexpensive, lightweight component parts and simplified assembly, thereby providing a number of desirable features and factors.

SUMMARY OF THE INVENTION

The present invention provides a collapsible gun bipod which is relatively lightweight, inexpensive and simple to set up. The gun bipod utilizes two rigid legs and flexible coupling members to permanently yet flexibly attach such legs to one another in either a fixed or variable manner. One such coupling member comprises a flexible yoke, and when the bipod is opened, the legs are spread apart with the yoke functioning as a central point of rotation. Each of the two legs has a cover portion for accommodating the gun barrel, and a nonskid base for contacting the ground. A clasping retainer is secured to one of the legs and provides a means for temporarily attaching and restraining the other leg when the bipod is closed. A cord extends along one such leg, thereby providing a convenient means of grasping or carrying the bipod. An optional gun barrel strap may be provided to more securely position or hold the gun when desired.

DETAILED DESCRIPTION OF THE DRAWINGS

DESCRIPTION OF PREFERRED EMBODIMENTS

Figure 1:
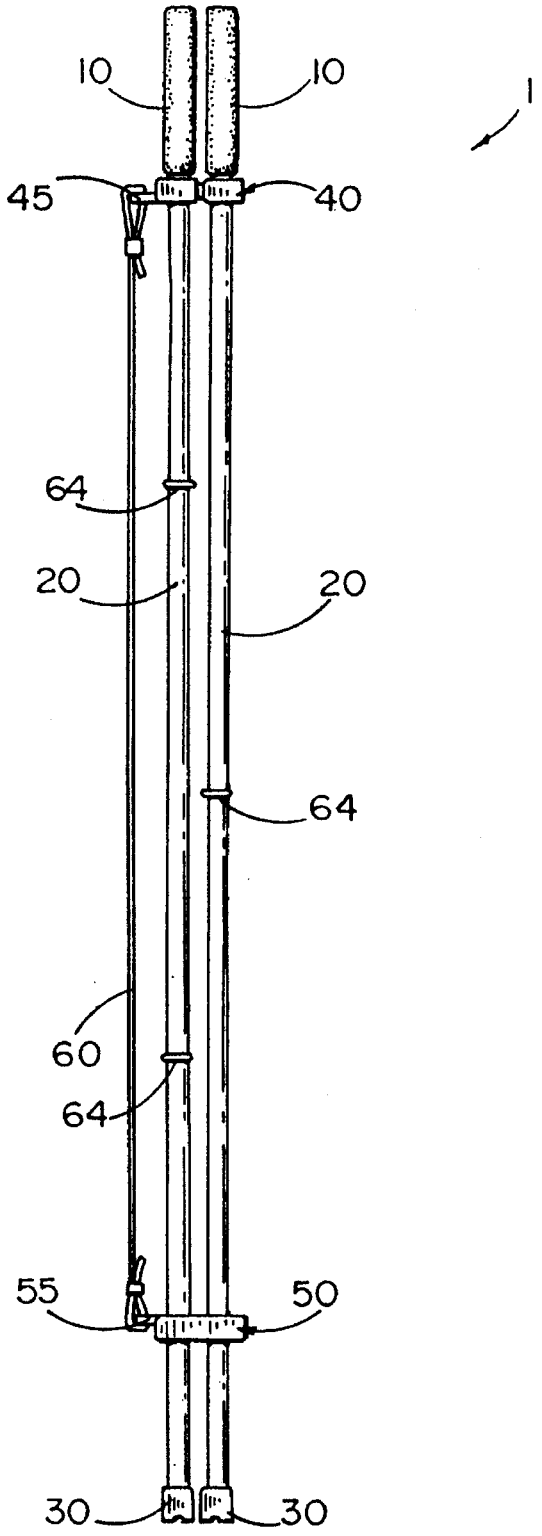
FIG. 1 is an elevational view illustrating a first embodiment of the present invention in its closed state.

A first embodiment of the invention in the form of a collapsible or foldable bipod 1 is generally illustrated in FIG. 1 and comprises a pair of legs 20, 20', each having a grip or cover portion 10 attached at one end and a base 30 affixed to the other end. The two legs are retained in close proximity to one another by a flexible yoke 40 and a clasping retainer 50. The yoke 40 and retainer 50 each have tab-like portions 45 and 55 extending laterally outward for attaching an elastic cord 60 thereto. O-rings 64 are preferably positioned on each leg 20 at various positions along their length, as noted further below.

The following description for leg 20 applies to either of the two legs. Leg 20 may be formed from any rigid, lightweight, weather-resistant material, but the preferred material of 20 is wood e.g., a hardwood rod, preferably coated or impregnated with weather-proofing material. Leg 20 as described herein preferably has a circular cross section, however the present invention is not limited to such geometries. Each leg 20 should have a cross section at least large enough such that each leg 20 will adequately support up to about 20 pounds of longitudinal force. Generally speaking, hardwood rod diameters of approximately one-half inch or thereabouts are suitable for such applications. The length of leg 20 is dictated by the particular demands of the hunter and hunting application, however lengths from about 2 feet to about 4 feet are preferred and a particular preferred length is about 40 inches.

Figure 2:
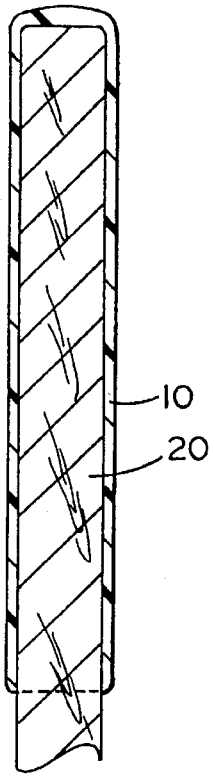
FIG. 2 is an enlarged fragmentary view illustrating a longitudinal cross-section of the upper end of one leg and the corresponding grip attached thereto.
Figure 3:
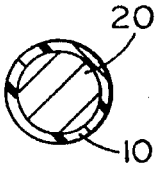
FIG. 3 is a cross-sectional view taken along the plane III—III of FIG. 2.

Each leg 20 has a corresponding grip or cover 10 attached at one end. Grip 10, as shown in FIGS. 2 and 3, may be formed from any weather-resistant, sound-deadening material, preferably a moderately soft plastic having a resilient and non-marring surface. Grip 10 may be molded directly onto the end of leg 20, or separately formed (as a tube having one closed end, for example) and then attached to leg 20 by a variety of methods such as by the use of a weather-resistant adhesive, or simply by friction. Preferably, grip 10 covers the entire outer periphery of the associated end of leg 20, as opposed to leaving portions of the leg exposed. Grip 10 should extend along the end of leg 20 a sufficient distance such that a gun barrel will contact grip 10 and not leg 20 when a gun is supported in the manner shown in the drawings. Typically, grip 10 extends from about 4" to about 6" along the end portion of leg 20.

Figure 4:
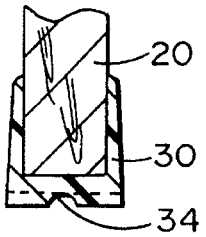
FIG. 4 is an enlarged fragmentary cross-sectional view showing the other end of one leg and the corresponding base attached thereto.
Figure 5:
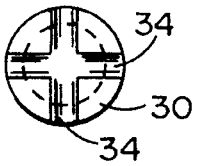
FIG. 5 is a bottom view of the base shown in FIG. 4.

Base 30, as illustrated in FIGS. 4 and 5, may be formed from any weather-resistant, durable and wear-resistant material providing a nonskid surface, thereby preventing legs 20 from slipping along the ground when the bipod 1 is in use. Base 30 is preferably formed from a material such as soft rubber or the like. Base 30 may be molded directly onto the end of leg 20, opposite the leg end having grip 10, or alternatively may be separately formed and then affixed to leg 20, opposite the leg end having grip 10, by a variety of methods, such as by the use of a weather-resistant adhesive, friction, etc. Additionally, base 30 may have one or more footing channels 34, or otherwise specially formed on its underside, to further minimize slippage of the base along the surface of the ground, which may be snow-covered or icy, etc.

Figure 6:
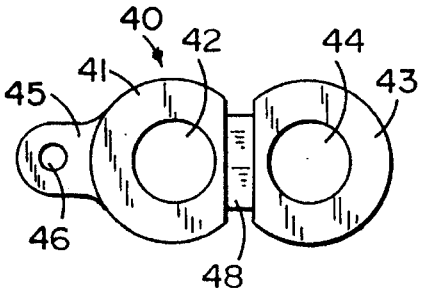
FIG. 6 is a top plan view of the flexible yoke component used in the illustrated embodiment of the present invention.
Figure 7:
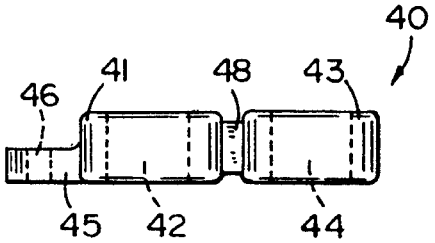
FIG. 7 is a side view of the flexible yoke component shown in FIG. 6.

Flexible yoke 40 shown in FIGS. 6 and 7 comprises first and second collar portions 41 and 43, a flexible interconnecting hinge portion 48, and the upper cord mounting portion 45. First collar portion 41 has a passage 42 extending through it to accommodate one of legs 20, and second collar portion 43 has a like passage 44 extending through it to accommodate the other leg 20'. Passages 42 and 44 should be formed such that their longitudinal axes are basically parallel to one another. When utilizing legs 20 of circular cross section, each passage 42 and 44 should have a generally circular cross section of a diameter comparable to that of legs 20. However, other cross-sectional geometries may be utilized for passages 42 and 44 so long as such geometries correspond at least generally to the cross section geometry of legs 20, 20'. First and second collar portions 41 and 43 are joined to one another by flexible hinge portion 48, which accommodates most of the flexing of yoke 40 when the bipod 1 is opened. Upper cord mounting portion 45 projects laterally outward from the outer surface of collar portion 41 and provides a passage 46 for attaching cord 60 thereto (FIG. 1).

Flexible yoke 40 should be secured in place to both legs 20, 20', and this may be accomplished in a variety of ways. For example, where yoke 40 is made of rubbery elastomeric material it may suitably hold itself in place by friction although some slippery substance may be needed for initial installation. A weather-resistant adhesive may be used for more positive retention, as may various mechanical fasteners including small nails (brads) or staples. Yoke 40 is preferably positioned at a point along both legs 20, 20' such that it is in contact or near-contact with the grips 10 attached to the ends of legs 20. However, in a broad sense yoke 40 may be located anywhere desired along legs 20, so long as it is between grips 10 and clasping retainer 50.

Flexible yoke 40 may be formed from practically any desired weather-resistant,flexible material. The preferred material for yoke 40 is a relatively soft thermoplastic such as thermoplastic olefin (TPO). The material selected should remain pliable at temperatures that will likely be encountered when using the device in the field, which may be as low as −20° F. when hunting in late fall or winter in northern localities.

Figure 8:
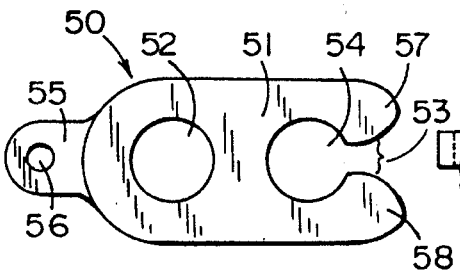
FIG. 8 is a top plan view of the clasping retainer component used in the illustrated embodiment of the invention.
Figure 9:
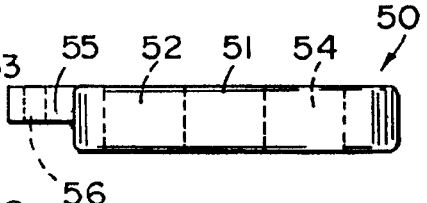
FIG. 9 is a side view of the clasping retainer of FIG. 8.

Clasping retainer 50 shown in FIGS. 8 and 9, comprises retainer body 51, having first and second passages 52 and 54 respectively passing therethrough, lower cord-receiving portion 55 having cord passage 56 passing therethrough and, formed at one end of retainer body 51, clasping extensions 57 and 58 having entryway 53 formed therebetween. Clasping extensions 57 and 58 are sufficiently flexible to allow a leg 20 to enter second passage 54 through entryway 53. Once passage 54 has received leg 20, clasping extensions 57 and 58 restrain leg 20 from exiting passage 54. However, upon application of sufficient force to leg 20 towards entryway 53, extensions 57 and 58 flexibly diverge from one another thereby allowing leg 20 to disengage from passage 54. Passages 52 and 54 should be formed such that their longitudinal axes are basically parallel to one another. When utilizing legs 20 of circular cross section, each passage 52 and 54 should have a generally circular cross section of a diameter comparable to that of legs 20, 20' However, other cross section geometries may be utilized for passages 52 and 54 so long as such geometries generally correspond to the cross section geometries of legs 20. Lower cord-receiving portion 55 projects laterally outward from the end of retainer body 51 opposite entryway 53.

Clasping retainer 50 is fixedly attached to one of the legs 20' which extends through first passage 52, by the use of a weather-resistant adhesive, mechanical fastener or other such means as noted above. Retainer 50 is preferably positioned at a point along the leg 20 wherein the distance from base 30 to retainer 50 is about 4" to about 12". However, retainer 50 may be located practically anywhere desired along leg 20, so long as it is between flexible yoke 40 and base 30 and at least moderately spaced from yoke 40.

Clasping retainer 50 may be formed from any weather-resistant, sound-deadening material, preferably a relatively soft thermoplastic. The material selected should remain pliable at the particular temperatures that will likely be encountered when using the device. Accordingly, retainer 50 should remain pliable at similar temperatures as those considered in connection with flexible yoke 40.

Elastic cord 60 extends from upper cord portion 45 of flexible yoke 40 to lower cord portion 55 of clasping retainer 50, as shown in FIG. 1, by attachment to the respective cord passages 46 and 56 shown in FIGS. 6 and 8. Elastic cord 60 may be formed from any suitable elastomeric material, e.g. "Bungee" cord of about ⅛ inch diameter, which preferably is slightly stretched upon attachment to portions 45 and 55. By doing so, cord 60 will remain taut and not sag or droop, thereby keeping the cord in a neat, parallel relationship with legs 20. Of course, in a broad sense practically any durable carrying cord may be used, and in fact may be eliminated if no such carrying convenience is deemed necessary. As illustrated, cord 60 may be attached in place by a clamp 62 of a desired nature (e.g., a soft metal collars wedged in place tightly about the looped cord), or in other ways such as by merely tying it into a knot and, preferably heating the end of the cord to form a small, neat knob which avoids fraying as well a inadvertent loosening of the knot.

One of more O-rings 64 illustrated in FIG. 1 may be positioned on each of legs 20 to prevent direct contact between legs 20, 20' when the gun bipod 1 is closed or carried. Such direct contact may result in noise generation, which is undesirable during hunting. O-rings 64 may be formed from practically any weather-resistant, elastomeric material.

Figure 10:
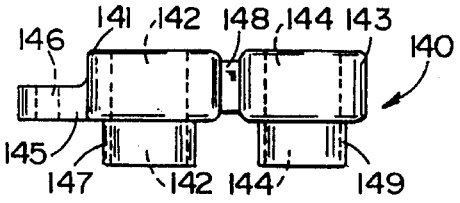
FIG. 10 is a side view of a second embodiment of the flexible yoke component.

A second embodiment of the flexible yoke component, designated by the numeral 140, is illustrated in FIG. 10, wherein thin-walled cylindrical extensions 147 and 149 project outward from collars 141 and 143 respectively. The general construction and description given for the flexible yoke 40, depicted in FIGS. 6 and 7, also applies to the second embodiment 140 of this element. The extensions 147 and 149 extend substantially parallel to the longitudinal axes of passages 142 and 144. Extensions 147 and 149 are formed such that passages 142 and 144 continue through the respective extension without a significant change in diameter or cross-sectional geometry. Extensions 147 and 149 are preferably integrally formed during the manufacture of flexible yoke 140, although corresponding separate extensions which could be formed separately and subsequently attached to or adjacent the collars 141 and 143. The extensions 147 and 149 are preferably formed from the same material used for forming flexible yoke 140, which is that material described for flexible yoke 40.

Figure 11:
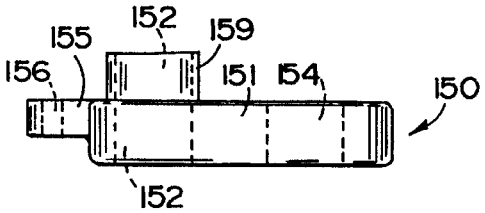
FIG. 11 is a side view of a second embodiment of the clasping retainer component.
Figure 12:
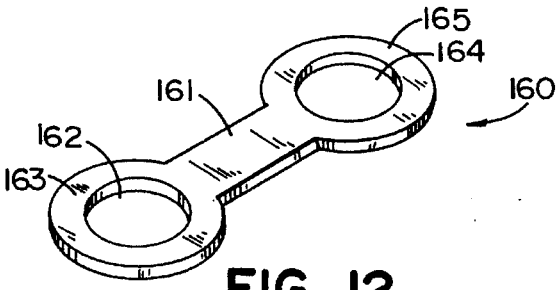
FIG. 12 is a perspective view illustrating an optional gun barrel strap component for use with the present invention.

A second embodiment of the clasping retainer component, designated 150, is illustrated in FIG. 11, wherein a thin-walled cylindrical extension 159 projects outward from retainer body 151. The general construction and description given for the clasping retainer 50, depicted in FIGS. 8 and 9, applies to the second embodiment 150 of this component. The extension 159 extends substantially parallel to the longitudinal axis of passage 152. Extension 159 is formed such that passage 152 continues through extension 159 without a significant change in diameter or cross-sectional geometry. Extension 159 is preferably integrally formed during the manufacture of clasping retainer 150, however, it could also be formed separately and subsequently attached to retainer body 151. Extension 159 is preferably formed from the same material used for forming clasping retainer 150, which is that material described for clasping retainer 50.

Figure 16:
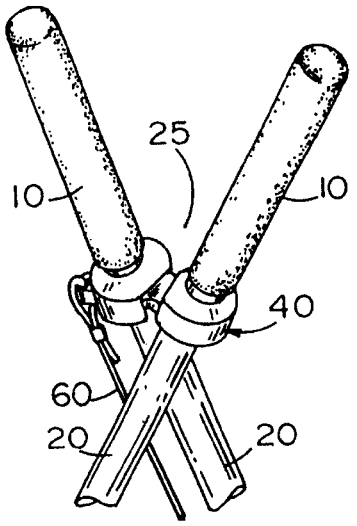
FIG. 16 is an enlarged fragmentary view illustrating the relationship between the flexible yoke and legs of the first embodiment of the present invention when in its open state.

The extensions 147, 149 and 159 provide additional surface contacting legs 20, 20', and thus help to retain the associated yoke component or clasping retainer in place upon its respective leg by helping to prevent slippage there between. That is, the extensions 147, 149 and 159 provide additional space for adhesive along legs 20, 20' where that medium of attachment is used, and also will provide additional friction force where that is relied upon for retention. In addition, each such extension provides a flange-like surface through which a mechanical fastener such as a small nail or staple, 100 (FIGS. 10 and 11) may be driven (preferably by pneumatic or other powered devices) to ensure position retention. Alternatively, the fastener 100 may extend through the collar portion 41, 43, 141, 143 of the flexible yoke 40, 140, and/or through the analogous portion of the clasping retainer 50, 150 (FIG. 16), and this is currently viewed as the best mode and preferred embodiment since it is simple and very reliable.

The present invention may also incorporate an optional barrel strap component 160 shown in FIGS. 12–14 and 17. Barrel strap 160 comprises two relatively thin rings 163 and 165 connected by a flexible strap 161. Each ring 163 and 165 has a passage 162 and 164 respectively formed in its center. The diameter and cross-sectional geometry of passage 162 and 164 should substantially match that of the corresponding leg 20, which passes therethrough. Barrel strap 160 may be formed from any durable, weather-resistant, flexible material, however rubber-type materials are preferred. The material selected should remain pliable at the particular temperatures that will likely be encountered when using the device.

Figure 13:
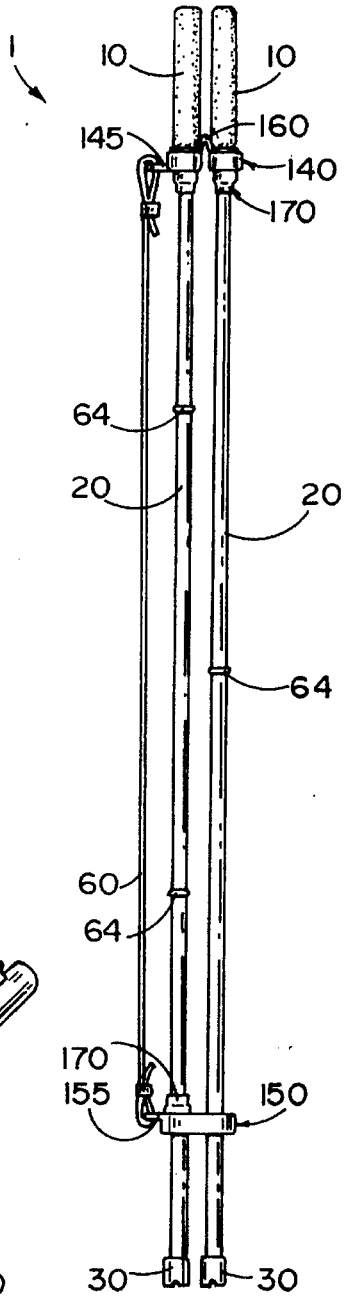
FIG. 13 is an elevational view similar to FIG. 1 but illustrating an embodiment of the present invention utilizing the barrel strap depicted in FIG. 12 and a means of attaching and sealing the flexible yoke and clasping retainer depicted in FIGS. 10 and 11, respectively, to the legs.

Another embodiment of the invention utilizing flexible yoke 140 and clasping retainer 150, is illustrated in FIG. 13. In this embodiment, a short length of shrink tubing 170 is telescoped over extensions 147 and 149 of flexible yoke 140 and extension 159 of clasping retainer 150. Each such portion of shrink tubing 170 should be of sufficient length to cover substantially all of the corresponding extension 147, 149 and 159. The length of tubing 170 should be such that upon positioning over the respective extension, tubing 170 extends approximately 1 inch past the distal end of the extension, thereby contacting the particular leg 20, 20'. Tubing 170 should have a diameter such that, prior to heating, the tubing may be slipped over the particular extension and, subsequent to heating, the tubing is securely constricted about the underlying extension and leg 20, thereby effectively sealing the region between the extension and leg 20. Shrink tubing 170, in addition to performing a sealing function, also functions to ensure that flexible yoke 140 and clasping retainer 150 do not slide along the length of legs 20. Accordingly, the use of tubing 170 may eliminate the need for adhesive to bond yoke 140 and/or retainer 150 to legs 20.

Figure 14:
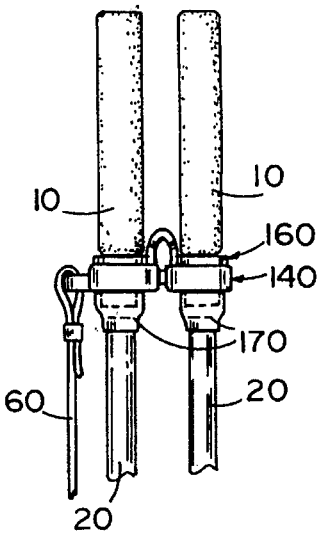
FIG. 14 is an enlarged fragmentary elevational view illustrating the relationship of the flexible yoke and barrel strap depicted in FIGS. 10 and 12, respectively, in the embodiment of the invention depicted in FIG. 13.

The preferred orientation of flexible yoke 140, clasping retainer 150, barrel strap 160, and shrink tubing 170 is illustrated in FIGS. 13 and 14. Extensions 147 and 149 of flexible yoke 140 extend towards the lower ends of the legs 20, 20', i.e. toward the bases 30. Extension 159 of clasping retainer 150 extends towards the opposite end of the legs 20, 20', i.e. toward the grips 10. Each extension 147, 149, and 159 is covered and sealed by an effective amount of shrink tubing 170. Gun barrel strap 160 is located between grips 10 and flexible yoke 140.

Figure 15:
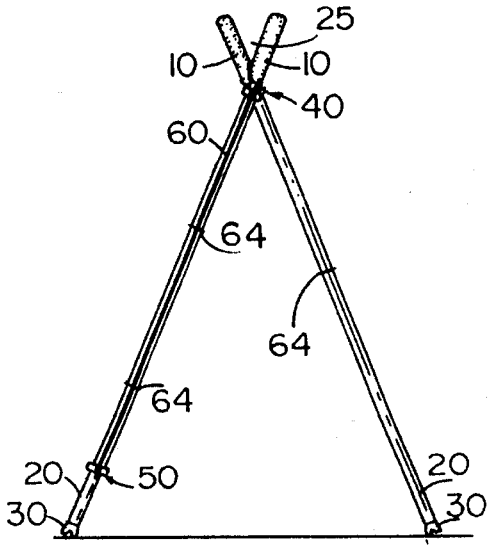
FIG. 15 is an elevational view on a reduced scale illustrating the invention in its open state.

In use, apparatus of the invention may be kept in its closed position as illustrated in FIGS. 1 and 13 during transport and storage. The following descriptions of use, although referring to the first embodiment of the present invention, applies equally as well to the other embodiments. The device may readily be carried upon the hunter's back or at his or her side by means of elastic cord 60. Upon reaching the desired site, or place of use, the device is opened to the position illustrated in FIGS. 15 and 16 by merely pulling one of the legs 20, 20' out of the retaining recess 54 of the clasping retainer 50 through the associated slot 53, and then spreading the legs apart about a central point of rotation, i.e. flexible yoke 40. By spreading legs 20 apart from one another, a large inverted "V" is formed, extending from the base 30 end of legs 20 to rest point 25, and a smaller upright "V" formed by grips 10 and rest point 25. Once the hunter is assured that the base 30 end of each leg 20 is firmly positioned on the ground below, the gun barrel may then be placed in the small upright "V" formed between grips 10 and supported at rest point 25.

The height of rest point 25 is determined by the angle of the inverted "V" formed between legs 20 when separated, and it may be noted that the device may readily, and instantly, be used as a monopod, i.e., a simple hand-engagable shooting support which is manually held vertically by one hand, which is also used to support the gun barrel. By increasing the angle between legs 20, rest point 25 is lowered. Thus, the height of rest point 25 may be instantly adjusted by changing the relative angle of legs 20, and the preferred flexible yoke 40, 140 will readily permit many such different angular adjustments without the necessity of having to loosen any mechanical fasteners, etc. At the same time, there is in effect an automatic position of maximum angulation at the joint where the yoke has twisted to its effective maximum allowable extent in the overall structure, and each of the bases 30 may be made pointed if desired so as to fixedly engage the earth, etc. at any particular relative separation, to thereby positively fix the corresponding elevation of tile gun support position. Further, the elastomeric nature of the preferred flexible yoke 40, 140, provides an inherent resilient biasing effect which automatically returns the device to its collapsed or folded initial "monopod" position when it is picked up after use. Thus, while other forms of pivotal leg-attachment means may potentially be used, and mechanical connector devices may provide manual locks or position-indexing means, the flexible form of the yoke device is nonetheless preferred.

Figure 17:
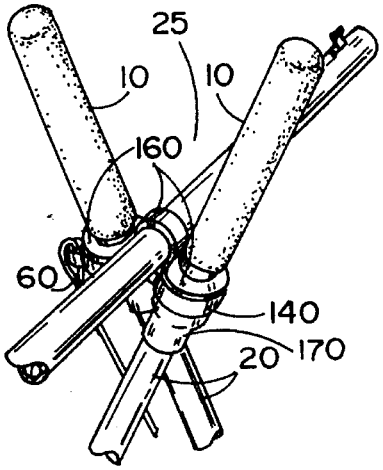
FIG. 17 is a view similar to FIG. 16, but illustrating the embodiment of the present invention depicted in FIGS. 13 and 14.

FIG. 17 illustrates the second embodiment of bipod 1 in its open state, with the optional gun barrel strap securing a gun barrel. Barrel strap 160 functions to firmly hold the gun barrel to the bipod 1 at rest point 25 by extending and stretching over the gun barrel, thereby minimizing the possibility of the gun slipping from its resting position. This arrangement is particularly useful when the apparatus is being used as a gun rest or holder during an interval in which the user is not anticipating any actual shooting. Under these circumstances the device and the gun together may be used as a tripod, the gun resting with its butt on the ground and thus becoming the third leg of the tripod. That is, rather than laying the gun upon the ground or leaning it against trees or the like, the gun butt may be placed upon the ground and the barrel placed in the smaller upright "V" formed by grips 10 and resting at rest point 25, thereby constituting a third leg of the resulting tripod. Thus, a sturdy and secure means of gun support is provided without the problems or potential dangers typically encountered when laying the gun upon the ground or against a tree. Moreover, if the hunter chooses to not position the gun barrel between strap 160 and rest point 25, the strap may merely lay in the region of rest point 25 with the gun barrel laying on top of it, with strap 160 thus further cushioning the gun. This is more often the case during hunting, when events are likely to be more sudden.

Figure 18:
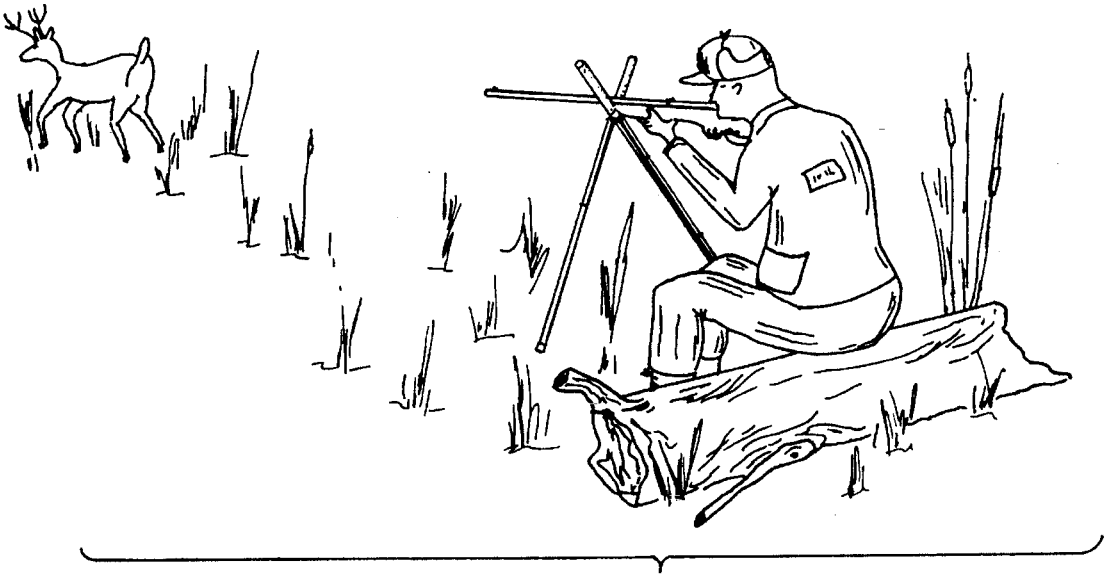
FIG. 18 is a pictorial view generally illustrating a hunter using the present invention.

FIG. 18 illustrates the device 1 in use as a bipod, i.e. as a shooting stand. In this use of either the first or second embodiment, the device may serve as a temporary shooting support. This application would most typically arise during hunting from a blind or other concealed position, when the hunter has a relatively long and difficult shot, requiring a high degree of accuracy, and especially where the quarry is substantially hidden or concealed by brush or other cover and is slowly moving along between openings where a reasonable opportunity for a higher percentage shot may occur. Under these conditions the device not only enhances accuracy to a substantial degree, but also allows the hunter to keep the gun trained on the target without physically holding the weight of the weapon throughout the entire interval involved.

In addition to the various uses described herein, the gun bipod 1 is especially useful in the course of targeting a gun or adjusting the sights of a gun particularly when in the field or where there are no bench rests available.

The gun bipod 1 may also be used in conjunction with nearly any type of handgun. In such applications, the gun bipod is especially beneficial for long-distance shots requiring substantial accuracy and/or aiming time.

Since the gun bipod of the present invention is comprised of relatively few components, and they are of an uncomplicated nature, it may be readily and inexpensively manufactured and assembled and may be sold or distributed in kit form.

It will become apparent to those skilled in the art upon consideration of the foregoing detailed disclosure that various modifications to the preferred embodiments of the invention as described herein can be made without departing from the spirit or scope of the invention, as defined by the appended claims.

The embodiments of the invention in which an exclusive property or privilege is claimed are defined as follows.

1. A collapsible gun support and shooting rest device which comprises:

a bipod comprising a pair of generally rigid legs;

a coupling interconnecting said legs for angular movement relative to one another between at least first and second positions determined at least in part by said coupling;

said first position being one in which said legs lie generally parallel one another and said bipod is collapsed for carrying or storage, and said second position being one in which said legs rotate relative to one another to form an X shape; and a holder for helping retain said legs in at least their said first position to facilitate carrying and storage of said device.

2. A collapsible gun support device in accordance with claim 1, wherein said coupling includes a resilient biasing member for urging said legs to their first position.

3. A collapsible gun support in accordance with claim 1, wherein said coupling comprises a yoke having a pair of spaced leg-receiving portions interconnected by a moveable portion.

4. A collapsible gun support in accordance with claim 3, wherein said movable portion of said yoke comprises a flexible member.

5. A collapsible gun support in accordance with claim 4 wherein said flexible member comprises a resiliently deformable element.

6. A collapsible gun support in accordance with claim 5, wherein said resiliently deformable element comprises a biasing member for urging said legs toward their first position.

7. A collapsible gun support in accordance with claim 6, wherein said yoke comprises a one-piece member.

8. A collapsible gun support in accordance with claim 7, wherein said yoke comprises a one-piece member formed of resilient material.

9. A collapsible gun support in accordance with claim 1, further including a protective base portion at an end of each of said legs spaced from said coupling.

10. A collapsible gun support in accordance with claim 9, wherein said legs are formed from wood.

11. A collapsible gun support in accordance with claim 10, wherein said base is formed from an elastomeric material.

12. A collapsible gun support in accordance with claim 8, wherein said yoke is formed from a flexible thermoplastic, said thermoplastic being of a type which remains pliable at temperatures at least as low as about 10° F.

13. A collapsible gun support in accordance with claim 1 including sound-deadening material disposed along at least one of said legs.

14. A collapsible gun support in accordance with claim 13, wherein said sound-deadening material generally encircles said at least one leg.

15. A collapsible gun support in accordance with claim 14, wherein said sound-deadening comprises at least one annular member disposed on said at least one leg.

16. A collapsible gun support in accordance with claim 5, and further including a protective cover disposed on surface portions of said legs at their ends closest said coupling.

17. A collapsible gun support in accordance with claim 16, including sound-deadening material disposed along at least one of said legs, and wherein said sound-deadening comprises at least one annular member disposed on said at least one leg at a point disposed on the opposite side of said coupling from said protective cover.

18. A collapsible gun rest which comprises:

a pair of generally rigid legs, each leg having a covering material disposed thereon at a first end portion;

a first connector coupling said legs to one another at a point between their ends in a manner permitting connected relative movement of said legs from a generally parallel disposition in which they are collapsed to one of at least acute relative angularity in which one such leg lies across the other to form an X shape having an upper crotch-like portion, said covering material disposed on said leg portions defining said crotch-like portion, to thereby provide a covered rest for supporting a firearm.

19. A collapsible gun rest according to claim 18, wherein said covering comprises a sleeve-like member disposed over substantially all of the outer surface of each of said leg end portions.

20. A collapsible gun rest according to claim 18, wherein said covering comprises cushioning members for protectively receiving said firearm.

21. A collapsible gun rest according to claim 18, wherein said first connector comprises a flexible member.

22. A collapsible gun rest according to claim 21, wherein said first connector comprises a resiliently flexible member.

23. A collapsible gun rest according to claim 18, further including a second connector spaced from said first connector, said second connector releasably coupling said legs together.

24. A collapsible gun rest according to claim 23, wherein at least one of said first connector and second connector comprise a resiliently flexible member.

25. A collapsible gun rest according to claim 24, wherein said first connector and second connector are formed from a flexible thermoplastic, and thermoplastic being of a type remaining pliable at sub-freezing temperatures.

26. A foldable gun rest which comprises:

a pair of generally rigid legs, each leg having a gun-rest portion at a first end and a foot portion at a second end; and a yoke comprising an integral member defining a first collar shaped to receive one of said legs and a second collar shaped to receive the other such leg, said yoke further having a flexibly hingeable portion connecting said first collar and said second collar, whereby said legs may be moved relative one another between a folded and unfolded position while received by said first and second collars;

whereby said gun-rest portions of said pair of generally rigid legs are held in position to receive and support a gun when said legs are in their said unfolded position, for more steady shooting and enhanced marksmanship.

27. A foldable gun rest in accordance with claim 26, wherein said flexibly hingeable portion is resilient.

28. A foldable gun rest in accordance with claim 27, wherein said yoke comprises a one-piece member.

29. A foldable gun rest in accordance with claim 28, wherein said, one-piece yoke member is formed by molding resiliently flexible thermoplastic material.

30. A foldable gun rest in accordance with claim 28, wherein said flexibly hingeable portion comprises a narrowed section of said one-piece member to enhance compound flexure thereof when said legs are moved relative one another.

31. A foldable gun rest in accordance with claim 30, wherein said one-piece member has a center portion disposed generally between said first and second collars, and said center portion includes said narrowed section.

32. A foldable gun rest in accordance with claim 31, wherein said one-piece member has a length, width and thickness; and said narrowed section is located in at least one of said width and thickness.

33. A foldable gun rest in accordance with claim 32, wherein said narrowed section is located in said thickness.

34. A foldable gun rest in accordance with claim 26, further including a retainer having a first portion secured to one of said legs and a second portion extending away from said first portion and toward the other of said legs, said second portion being releasably engageable with said other of said legs to retain the latter generally adjacent said one leg for compact transport of said gun rest.

35. A foldable gun rest in accordance with claim 34, wherein said second portion of said retainer includes at least one clasping portion shaped to extend at least partially around said other of said legs to thereby claspingly receive the latter.

* * * * *